United States Patent [19]

Patel

[11] 4,180,053

[45] Dec. 25, 1979

[54] FIREPLACE ENERGY RETRIEVER

[76] Inventor: Rashmikant Patel, 697 Yorkhaven Rd., Cincinnati, Ohio 45240

[21] Appl. No.: 883,699

[22] Filed: Mar. 6, 1978

[51] Int. Cl.[2] ..... F24B 7/00

[52] U.S. Cl. ..... 126/132; 126/164; 126/121

[58] Field of Search ..... 126/120, 121, 132, 142, 126/143, 164, 101, 5; 122/247, 353, 373

[56] References Cited

U.S. PATENT DOCUMENTS

| | | | |
|---|---|---|---|
| 112,120 | 2/1871 | Burrell | 122/247 |
| 547,802 | 10/1895 | Page | 126/132 |
| 1,211,728 | 1/1917 | Londelius, Jr. | 122/373 |
| 1,252,176 | 1/1918 | Read | 126/132 |
| 1,432,538 | 10/1922 | Dearmond | 126/132 |
| 1,586,576 | 10/1920 | Pendell | 122/373 |
| 4,025,043 | 5/1977 | Cleer, Jr. | 126/132 |
| 4,088,113 | 5/1978 | McIntire | 126/132 |

*Primary Examiner*—Carroll B. Dority, Jr.
*Assistant Examiner*—Lee E. Barrett
*Attorney, Agent, or Firm*—Wood, Herron & Evans

[57] ABSTRACT

A coil of several turns in the form of a spiral is mounted in a domestic fireplace with its axis oriented horizontally and perpendicular to the front of the fireplace. The coil is supported as on legs, and serves as a grate for fuel placed within it from the front. A semicircular hood covers the upper portions of the turns of the spiral, and has a front end closure that blocks forward escape of smoke from the fireplace. Heat exchange liquid is circulated through the coil to be warmed by combustion of the fuel.

11 Claims, 2 Drawing Figures

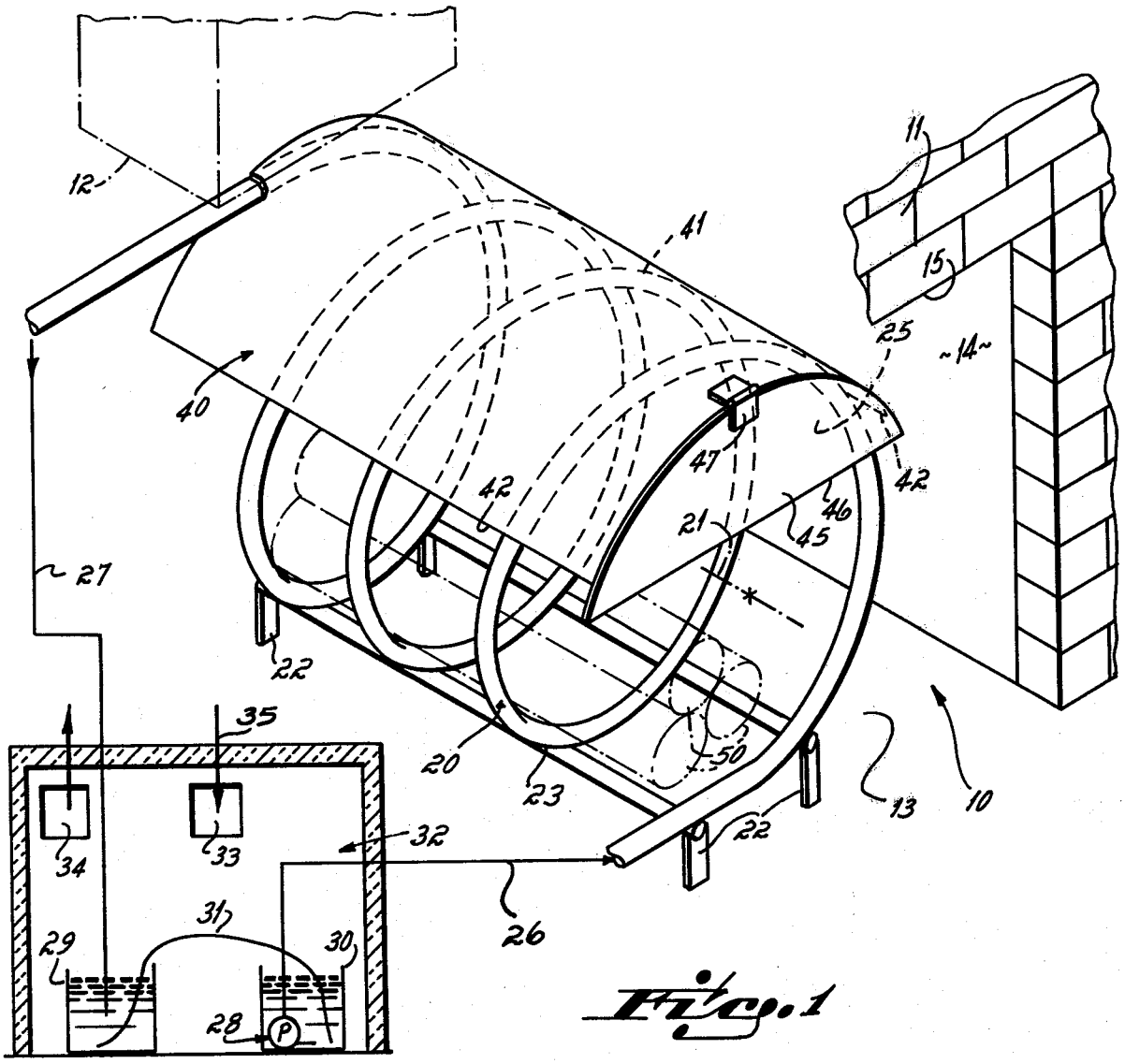
Fig. 1
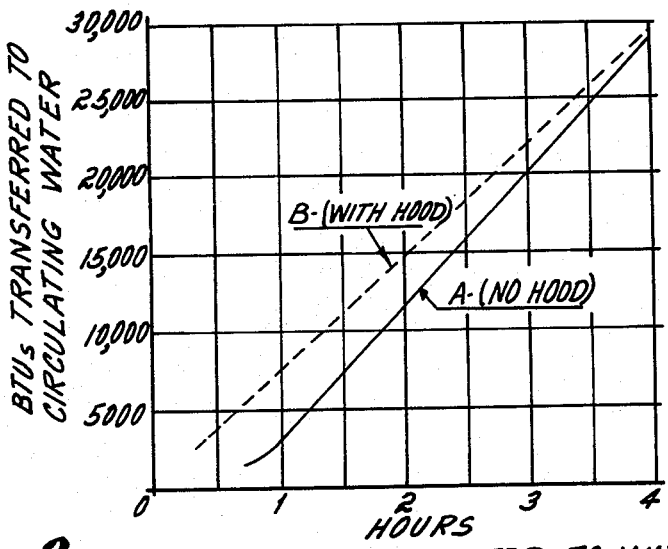
Fig. 2 RATES OF HEAT TRANSFER TO WATER IN COIL

FIREPLACE ENERGY RETRIEVER

FIELD OF THE INVENTION

This invention relates to domestic fireplaces, and more particularly to a heat exchanger installable in a fireplace to utilize otherwise wasted heat of combustion, for heating water.

BACKGROUND OF THE INVENTION

It is known to mount hollow firebacks, piping, and hollow grates in fireplace openings so that water can be circulated through them to be heated by a fire in the fireplace. The water so warmed can then be used as a heat exchange medium which can be circulated to radiators, hot water heaters, or to heat air which in turn is circulated for heating the dwelling. In general, however, prior devices have been expensive to fabricate, difficult to install, and relatively inefficient in extracting the heat of combustion.

BRIEF DESCRIPTION OF THE INVENTION

In accordance with this invention, a coil of tubing is provided in the form of a circular spiral of several turns, sized to fit within a conventional domestic fireplace. The coil is supported above the floor of the fireplace on mounting structure, and is so oriented that the axis of the coil extends horizontally, toward the front of the fireplace. The coil is of such diameter that fuel can be introduced into the interior of the coil from the front. The lower portions of the turns of the coil constitute a grate or support means to hold a fuel, such as logs, for burning, so that the fuel is burned within the coil. The upper portions of the turns circle above the lower portions so that air heated by fuel burning within the coil rises to the upper portions. Means are provided for circulating a heat exchange liquid, typically water, through the coil, to be heated by the burning of the fuel.

In the preferred embodiment of the invention, a hood is mounted over the upper portions of the turns in order to slow the movement of rising hot air past the upper portions. The hood is semicylindrical (chordal), as viewed endwise, and is supported by and above the coil. It may have a front end wall or closure extending downwardly across the upper part of the opening at the front of the coil, terminating in a lower edge which is above the center axis of the coil. This front end closure helps to block forward escape of smoke. The hood is open at the back of the coil to permit the escape of smoke to the flue. The side or longitudinal edges of the hood preferably terminate above the lower edge of the front end wall of the hood. This enables smoke to escape preferentially under the side edges, rather than under the front end wall.

An important advantage of the invention is its ease of construction, in comparison to other devices for recovering waste heat. The coil can be made from conventional copper tubing, by hand reshaping of the coil form in which such tubing is sold. The hood can be made of sheet metal; even heavy duty aluminum foil can be used, although it is not very durable.

The invention can best be further described and explained by reference to the accompanying drawings, in which, FIG. 1 is a perspective view, partially broken away, and somewhat diagrammatic, of a fireplace equipped with apparatus in accordance with a preferred embodiment of the invention; and FIG. 2 is a graph showing comparative rates of heating, with and without the hood.

DETAILED DESCRIPTION

In the drawing, a conventional domestic fireplace is designated at 10 in a chimney 11, having a flue 12 indicated by phantom lines. Fireplace 10 has a floor 13, sidewalls 14, and a top surface 15.

In fireplace 10, logs, coal or other fuel would conventionally be supported on fire dogs or in a grate or basket. This invention provides structure which may itself function as the grate to support the fuel above the fireplace floor 13. More specifically, a coil 20 is installed within the fireplace 10. The coil is made of several turns of tubing, for example conventional copper tubing of ½" diameter. The coil should be of a depth to extend well back into the fireplace, close to the back wall thereof. It will be noted that the coil axis 21 is horizontal and that it projects perpendicularly to the fireplace front opening, i.e., the coil end opens to the front of the fireplace.

By way of specific example, but without limitation, I have found that a coil about 23 inches in diameter, of 9 turns each spaced 2¼ inches apart, having a total length of 18 inches, made of approximately 56 lineal feet of tubing, is satisfactory for use in a conventional fireplace of 34½" height×29" width×23" depth.

The coil is supported above the floor 13 of the fireplace on supporting structure which may comprise legs 22 secured as by hard soldering to the lower portions 23 of the turns of the coil. Preferably, the clearance of the coil above the fireplace floor should be in the range of 3 to 4 inches to provide a draft space and clearance for ashes falling through the turns of the coil.

The respective ends of the tubing of coil 20 are connected to a water inlet line 26 and an outlet line 27, which run outside the fireplace to a reservoir to and from which water heated in the fireplace is circulated. Circulating means in the form of submersible pump 28 are provided to move water from the reservoir through the inlet line 26. The reservoir may comprise a conventional hot water heater, or it may be one or more 20 or 30 gallon galvanized containers as at 29 and 30. A siphon 31 connects the containers 29 and 30 to maintain equal water levels in them. Water from these containers can be circulated through radiators, or alternatively the reservoir can be used to heat air which is in turn circulated through the dwelling. As shown in the drawing, the reservoir containers 29 and 30 may be situated in an insulated room or chamber 32 which retains the heat of the water. Forced air ducts of an existing heating system 35 inlet to chamber 32 at 33 and lead from it as at 34. Air circulated through duct opening 33 by an existing blower system through the dwelling picks up heat in chamber 32 and is delivered through outlet 34.

The efficiency of heating the coil is very substantially improved by provision of a hood, designated generally at 40, over the upper portions 41 of the coil turns. The hood 40 is semicircular or chordal as viewed endwise, and its sides terminate in longitudinal lower edges 42, 42 parallel to the axis 21. The hood, which can sit directly on the coil turns, is open at the back so that smoke can escape rearwardly to flue 12. If the fireplace is provided with glass doors, as some conventionally are, no other front hood closure is needed. However, a hood front end closure or wall 45 may be provided between the sides to partially close the front end opening 25 of the coil. The front closure 45 terminates in a lower edge 46. This front closure may be hinged to the hood, as at 47, or may be removable for loading fuel, and preferably extends downwardly for about $\frac{1}{3}$ to $\frac{1}{2}$ the diameter of the coil, i.e., approximately to the axis of the coil, while the edges 42, 42 of the sides of the hood terminate somewhat above the front lower edge 46. The front closure 45 retards escape of smoke under the hood forwardly, through the front opening of the fireplace, and the smoke tends to escape preferentially under the side edges 42, 42. The hood can be made of sheet metal, for example 20 or 24 gauge aluminum.

Logs 50 (shown in phantom) are placed into the interior of the coil through the front opening 25 thereof. The lower portions 25 of the turns act as a grating to support the logs for combustion. It will also be noted that the upper portions of the turns 41 circle or pass above the lower portions. Thus, the lower portions of the turns are heated by direct contact with the burning logs while the upper portions are heated by rising gases of combustion. The hood slows the rate of movement of the hot gases past the upper portions of the turns, thereby providing longer contact with the coil, thereby to improve the heat exchange to the upper portions of the turns.

The following example illustrates the operation of the invention and demonstrates the surprising effectiveness of the hood in improving the rate of heat exchange to the liquid circulated in the coil.

A coil of the dimensions previously given was connected to a water supply with a continuously operating circulating pump. The total weight of water in the system was 715 pounds. In a test with no hood in place, a fire was laid in the coil using logs whose total volume was 639 cubic inches. Newspaper kindling was added from time to time, in a total weight of 3 lbs. 11 oz. The starting temperature of the water was 60° F., and temperature readings were taken of the water in the reservoir at intervals. The heat absorbed by the water, as measured by its temperature rise and converted to BTU, is shown by line A in FIG. 2.

Using the same coil and reservoir, but with a hood in place over the coils, a test was run to show the effect of the hood in improving heat transfer. In this test, substantially less fuel was used, 473 cu. in. of wood and 1 lb. 14 oz. of newspaper. Nevertheless, the rate of temperature increase was much greater, as shown by line B in FIG. 2. It is especially significant to note that especially in the early period, within the first 1 hour after starting the fire, the use of the hood more than doubled the rate of heat transfer to the water.

With or without the hood, a substantial quantity of heat is recovered that otherwise would be wasted. This heat can be used to supplement the conventional domestic heating system.

While the foregoing description sets forth the preferred embodiment of the invention, those skilled in the art will realize that the invention is not limited to that embodiment but also includes other embodiments and variations within the scope of the following claims.

I claim:

1. Apparatus for installation in a domestic fireplace to recover waste heat from a fire therein, comprising, a coil of tubing in the form of a spiral of several turns, mounting structure for supporting the coil within said fireplace above the floor thereof, with the axis of the coil oriented horizontally and directed toward the front of the fireplace, said coil presenting an opening at the front end thereof, of such diameter that fuel can be introduced through said opening into the interior of the coil from the front of the fireplace, the lower portions of the turns of said coil constituting support means to hold said fuel for burning in the interior of said coil, the upper portions of the turns of said coil passing above the lower portions thereof so that air heated by fuel burning within said coil rises to said upper portions, means for circulating liquid through said coil, to be heated by the burning of said fuel, and a semi-cylindrical hood, said hood being positioned closely above the upper portions of said turns to slow the movement of hot air from a fire in the interior of said coil, past the upper portions, said hood having a front end closure which extends downwardly across the upper part of said opening at the front end of said coil, thereby to block forward escape of smoke from within said hood, the hood being open at the back of said coil to permit the escape of smoke thereunder to the rear of said fireplace.

2. The apparatus of claim 1 further wherein said front end closure terminates in a lower edge above said axis of the coil.

3. The apparatus of claim 2 further wherein said hood has side edges which terminate above the lower edge of said front end closure, thereby to enable smoke to escape preferentially under the side edges rather than under the front end closure.

4. The apparatus of claim 1 further wherein said front end closure is attached to said hood for movement away from said opening at the front end of said coil, for more easily introducing fuel into the interior of said coil.

5. The apparatus of claim 1 wherein said hood is made of sheet metal.

6. The apparatus of claim 1 wherein said fuel is wood logs and said coil is of a diameter and length to receive and support several such logs within it.

7. The apparatus of claim 6 further wherein the turns of said coil are so spaced, as measured in the direction parallel to the axis, as to provide support as a grate for fuel placed thereon in the interior of said coil, but sufficiently far apart that ashes can fall between the turns to the floor of said fireplace.

8. The apparatus of claim 1 further wherein said mounting structure comprises legs secured to said coil.

9. The apparatus of claim 1 further including a liquid reservoir, and wherein said circulating means circulates liquid from said reservoir through said coil, and returns it to said reservoir.

10. The apparatus of claim 9 further including an insulating chamber housing said reservoir, with means for circulating air heated in said chamber by liquid in said reservoir therein, to a dwelling to heat the same.

11. The apparatus of claim 1 wherein the turns of said spiral are substantially uniform in diameter.

* * * * *